United States Patent [19]

Dunning

[11] 4,032,388

[45] June 28, 1977

[54] TRANSFER MECHANISM

[76] Inventor: Leon Tucker Dunning, 911 Bond St., Sarnia, Ontario, Canada

[22] Filed: Nov. 19, 1975

[21] Appl. No.: 633,166

[52] U.S. Cl. ..... 156/568; 156/567; 156/571; 156/DIG. 29; 156/DIG. 31; 271/95; 271/120

[51] Int. Cl.[2] ..... B65C 9/10; B65C 9/14

[58] Field of Search ... 156/571, 568, 567, DIG. 31, 156/DIG. 42, 566, DIG. 29; 271/93, 95, 120, 118

[56] References Cited

UNITED STATES PATENTS

| | | | |
|---|---|---|---|
| 3,385,595 | 5/1968 | Benatar et al. | 271/95 |
| 3,567,559 | 3/1971 | Dullinger | 271/95 X |
| 3,723,228 | 3/1973 | Schaltegger | 156/571 X |
| 3,864,187 | 2/1975 | Carter | 156/568 X |

*Primary Examiner*—Charles E. Van Horn
*Assistant Examiner*—M. G. Wityshyn
*Attorney, Agent, or Firm*—Fetherstonhaugh & Co.

[57] ABSTRACT

A labelling device having a main body member mounted on its frame for rotation about a central axis. The device includes a labelling station, a glue applicator station and a label applicator station circumferentially spaced about a central axis. At least one arm member is slidably mounted on the main body member and projects radially from the central axis. A head is pivotally mounted on each arm for movement about a secondary axis parallel to the central axis. The head has an outer surface which is curved in the plane of rotation of the head about the central axis and is rotatable with the main body with the outer surface disposed in a path passing through the label storage, glue applicator and label applicator stations. The outer surface of the head has a leading edge disposed in the direction of rotation of the main body and a trailing edge disposed in the opposite direction. First guide means is provided for guiding the head to pivot about the second axis to angularly incline the head to a first position as it approaches the label storage station in which the trailing edge of the head is disposed radially outwardly of the leading edge whereby the trailing edge is the first portion of the head to engage the label in the storage station, the first guide means being adapted to cause the head to pivot about the second axis from the first position to a second position in which the leading edge is disposed radially outwardly of the trailing edge whereby the outer surface is rocked about the second axis during movement of the head through the label storage station. Suction means is provided for securing the label to the outer surface of the head as it moves through the label storage station to be transferred thereby to the labelling station.

9 Claims, 9 Drawing Figures

TRANSFER MECHANISM

FIELD OF INVENTION

This invention relates to transfer mechanisms. In particular this invention relates to a transfer mechanism for use in a labelling device of the type used to apply a gummed label to a container.

PRIOR ART

Considerable difficulty has been experienced in attempting to extract a label from a label dispenser and to secure the label to a container without damaging the label. Numerous rotary suction cup devices have been used in order to withdraw a label from a dispenser and in order to apply glue to the label prior to its application to a container. However, these devices have experienced considerable difficulty in making the required label transfer without damaging the label. During the operation of removing the label from the storage dispenser, relative movement between the label and the pick-off head has frequently resulted in scuffing or creasing of the label.

Difficulty has also been experienced in attempting to apply a coating of gum to a label without damaging the label either by scuffing or by creasing as a result of relative movement between the pick-off head and the glue applicator.

The present invention overcomes the difficulties of the prior art described above and provides a simple and reliable mechanism which is capable of removing items such as labels one at a time from the dispenser mechanism and transferring them to an applicator station. This objective is achieved by mounting a pick-off head so that the action of the head as it passes through the dispenser station is a rocking action so that the full arcuate surface of the pick-off head is placed in engagement with the item which is to be withdrawn from the dispenser unit with the trailing edge of the surface of the head being the first edge to engage the item which is to be withdrawn.

An improved dispenser action is achieved by forming the outer surface of the pick-off head with an arcuate curvature generated from the axis of rotation about which the head is mounted for rotation with respect to the frame of the machine and by providing suction passages arranged in two sets, one set adjacent each side edge of the head, each set of suction passages being independently connected to a vacuum source. As a result of this structure, the suction passages adjacent the trailing edge of the pick-off head are the first passages to effectively secure the label with respect to the head, there being no loss of suction efficiency due to the fact that the other passages which are uncovered are connected to the vacuum source through an independent passage. The passages at the leading edge of the head are rendered effective when the head rocks to a position wherein the leading edge engages the label.

The difficulties which have been encountered in attempting to apply a glue to a label by means of a glue applicator have been overcome in the apparatus of the present invention by forming the curvature of the pick-off head on an arc of curvature generated from the axis about which the head rotates with respect to the frame and by employing an applicator roller which is disposed substantially tangential to the path of the outer surface of the head so that the applicator roller rolls across the label during rotation of said head with respect to said frame.

The efficiency with which the labels are removed from the dispenser mechanism is further enhanced by mounting the dispenser head so that it is adapted to reciprocate radially towards and away from the label dispenser during the period of time in which the head is brought into engagement with the dispenser mechanism.

SUMMARY

According to an embodiment of the present invention, there is provided in a labelling device having a frame, a label storage station, a glue applicator station and a label applicator station circumferentially spaced from one another about a central axis of the frame, the label station having a label storage magazine opening inwardly therefrom for storing a plurality of labels in a face-to-face relationship, the improvement of a label transfer device comprising a rotor member mounted for rotation about the central axis of the frame, a head pivotally mounted on the rotor for movement radially with respect to the central axis and pivotal movement about a secondary axis which is disposed parallel to the central axis, the head having an outer surface which is curved in the plane of rotation of the head about the central axis, a first guide means for causing the head to pivot about the second axis to angularly incline the head to a first position as it approaches the label storage station in which the trailing edge of the head is disposed radially outwardly from the leading edge thereof so that the trailing edge is the first portion of the head to engage a label in the label storage station, the first guide means is adapted to cause the head to pivot about the second axis so that the outer surface thereof is rocked into engagement with the label from the trailing edge thereof towards the leading edge thereof, and means for securing the label to the outer surface of the head as it moves through the label station to transfer the label therefrom.

According to a further embodiment of the present invention, there is provided the further improvement in the labelling device described above which includes a second guide means for effecting reciprocal movement of the arm on which the head is mounted with respect to the main body during movement of the head between the point at which initial contact is made with the label and the point at which the head is finally withdrawn from the label storage station.

According to a still further embodiment of the present invention, there is provided a label transfer device as described above in which the head is formed with at least two sets of suction passages which are independent of one another, one set being disposed adjacent the trailing edge of the head and the other set being disposed adjacent the leading edge of the head, each set of passages being independently connected to a source of vacuum.

PREFEERRED EMBODIMENT

The invention will be more clearly understood after reference to the following detailed specification read in conjunction with the drawings, wherein FIG. 1 is a pictorial view of a labelling device according to an embodiment of the present invention;

Figure 1:
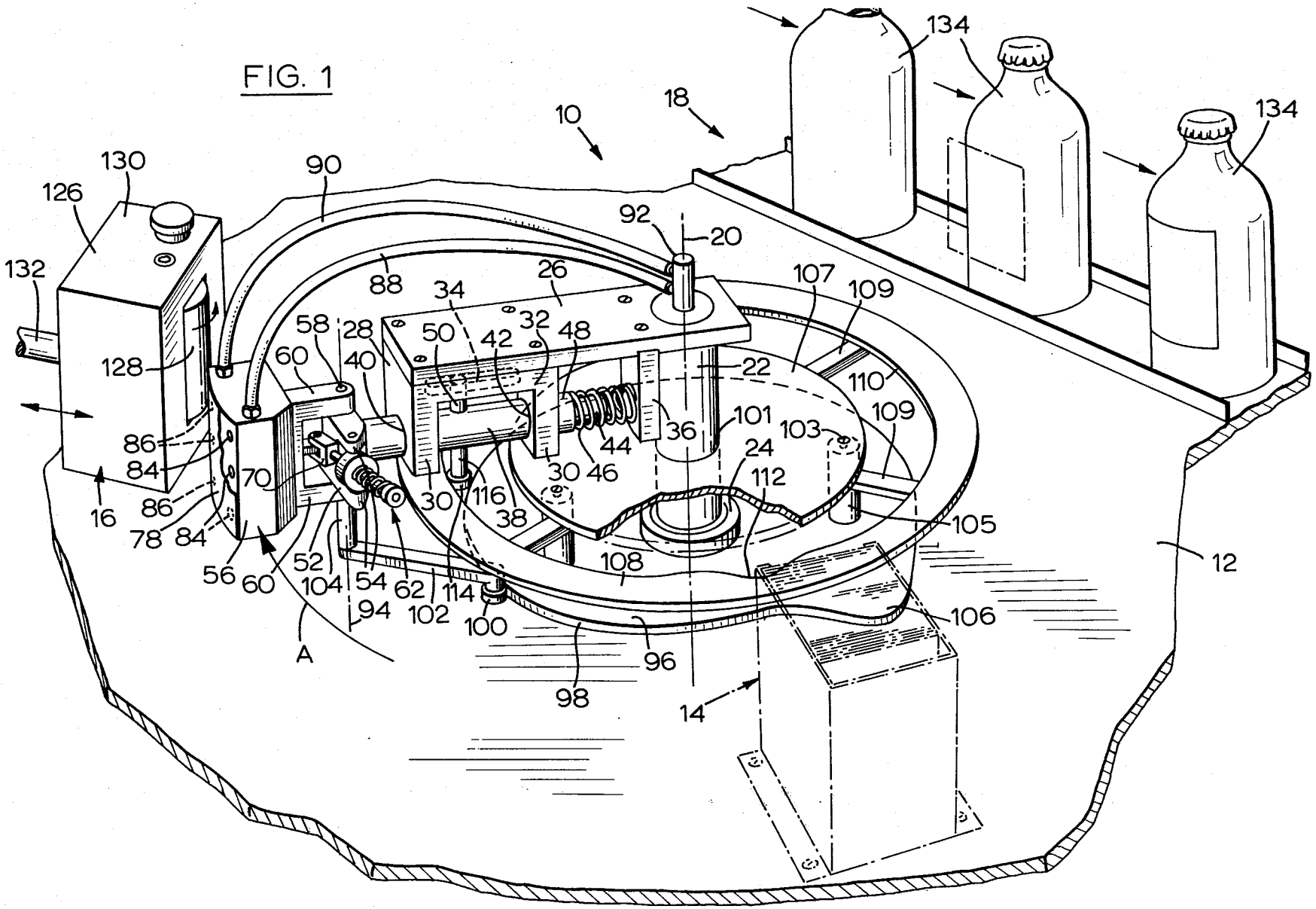

With reference to the drawings, the reference numeral 10 refers generally to a labelling device according to an embodiment of the present invention. The device includes a base plate 12 which is an integral part of the frame structure of the labelling machine. A label storage station 14, a glue applicator station 16 and a label applicator station 18 are located on the base plate at circumferentially spaced intervals with respect to vertical axis 20. A shaft 22 is mounted for rotation with respect to the base plate 12 about the vertical axis 20 by means of a suitable roller assembly 24. The shaft 22 is rotatably driven by means of a suitable drive train mechanism (not shown) which is carried by the frame. An arm 26 is rigidly secured with respect to the shaft 22 for rotation therewith. The arm 26 projects radially outwardly from the axis 20 and has a U-shaped bracket 28 at the outer end thereof. The U-shaped bracket 28 has a pair of flanges 30 which extend downwardly therefrom. The flanges 30 are connected by a radially extending bridge piece 32. An elongated slot 34 is formed in the bridge piece 32 and extends radially with respect to the axis 20. A stop plate 36 is secured to the arm 26 and extends downwardly therefrom adjacent the shaft 22. A shaft 38 is slidably mounted in passages 40 and 42 formed in the arms 30. The inner end of the shaft 38 is formed with a portion 44 of reduced diameter over which a return spring 46 is mounted. The spring 46 is located between the shoulder 48 and the stop plate 36. A guide pin 50 projects upwardly from the shaft 38 into the radially extending recess 34 and is slidable therein. The guide 50 serves to prevent rotation of the shaft 36 about its own longitudinal axis.

A bracket 52 is rigidly secured at the outer end of the shaft 38 and has a pair of lugs 54 projecting laterally therefrom. A pick-off head 56 is pivotally connected to the bracket 52 by means of a pivot pin 58 which extends through the bracket 54 and lugs 60 which project inwardly from the head 56.

Figure 6:
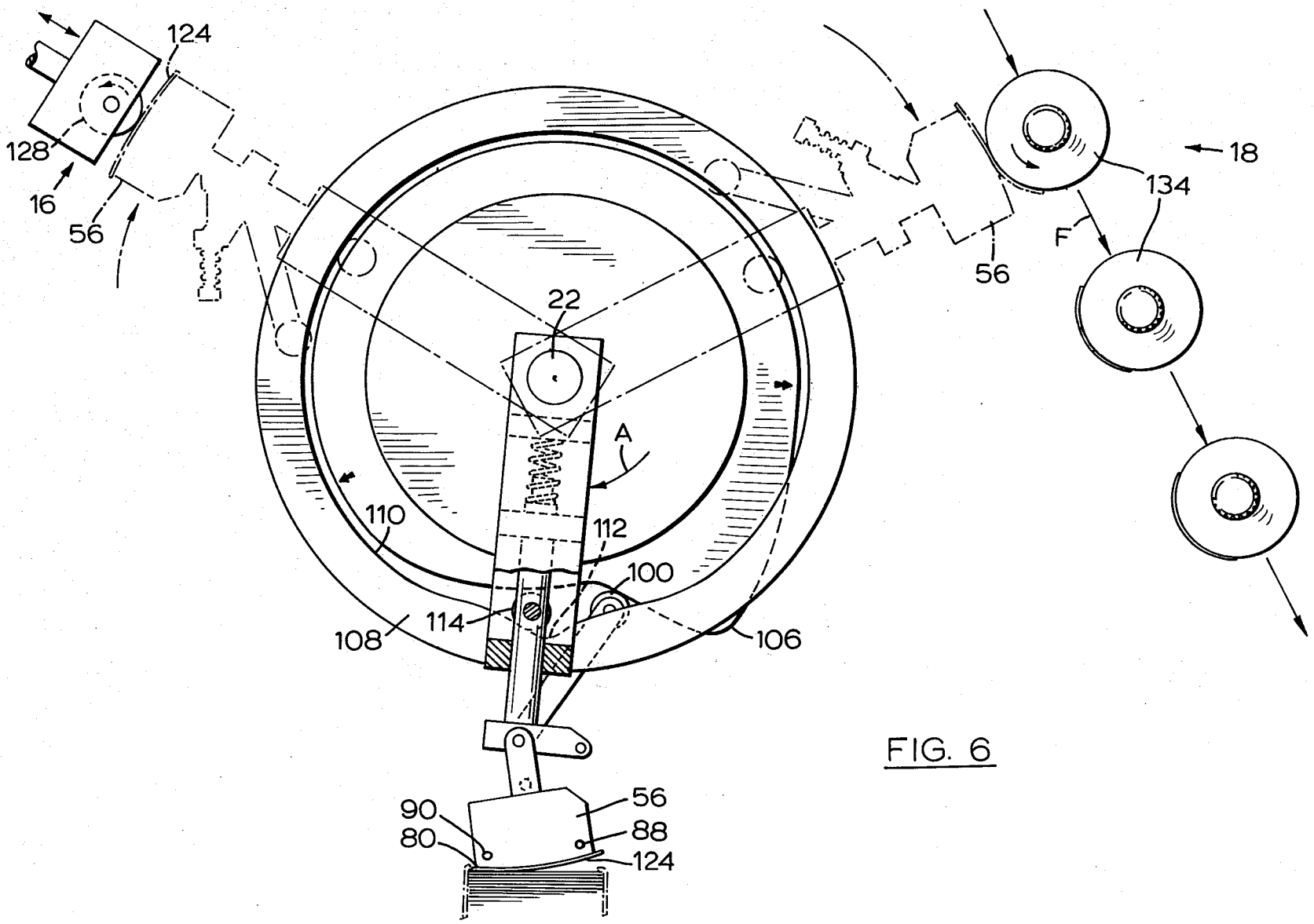
FIG. 6 is a further plan view illustrating a further position of the pick-off head together with the manner in which the head rotates through a glue station and label applicator station.

The pick-off head 56 is normally urged to the position shown in FIG. 6 of the drawings by means of a spring bias mechanism 62 which consists of a sleeve member 64 pivotally mounted between the lugs 54 of the bracket 52 by means of pivot pin 66 and a shaft 68 which passes through the sleeve 66 and is connected at its inner end to a lug 70 which projects rearwardly from the head by means of a pivot pin 72. The shaft 68 has an enlarged head portion 74 at the other end thereof and a spring 76 is mounted between the sleeve 64 and the head 74 so that it urges the head 74 away from the sleeve 64 and thereby urges the pick-off head 56 to the position shown in FIG. 6 as previously described.

The head 56 has an outer surface 78 which is curved in the plane of rotation thereof about the axis 20. The arc of curvature of the surface 78 is generated from a radius centered at the axis 20. The outer surface 78 of the head has a leading edge 80 and a trailing edge 82. A series of suction passages 84 open inwardly through the outer surface 78 of the head adjacent the trailing edge 82 and a further series of suction passages 86 open inwardly of the head through the outer surface 78 adjacent the leading edge 80. The first set of suction passages 84 is connected to a central vacuum source by means of a conduit 88 and the second set 86 is connected to a central vacuum source by means of a separate conduit 90. The conduits 88 and 90 are independently mounted on a central coupler 92 which is mounted for rotation with the arm 26.

As previously indicated, the head 56 is pivotally mounted with respect to the outer end of the shaft 38 by means of pivot pin 58. The head 56 is, therefore, mounted to pivot about a second axis 94 which is parallel to the central axis 20. The movement of the head 56 about the second axis 94 is controlled by means of a first cam 96 which is mounted on the base 12 and has a cam track 98 extending about the edge thereof. A cam follower 100 is rotatably mounted on a support arm 102 which is rigidly secured with respect to a shaft 104 which projects downwardly from the lower of the two lugs 60 of the head 56. The shaft 104 is rigidly secured with respect to the lower lug 60 such that rotation of the shaft 104 causes rotation of the head 56 about the axis 94. The cam track 98 has a node portion 106 spaced circumferentially in advance of the label dispenser station 14, the remainder of the cam track 98 extending about a circular path centered at the axis 20.

Reciprocal movement of the head 56 towards and away from the axis 20 is controlled by means of a second cam member 108 which has a cam track surface 110 on the inner edge thereof. The cam track 110 has a node recess 112 substantially aligned with the label dispenser mechanism 14, the remainder of the cam track 110 describes a substantially circular path about the central axis 20. A cam follower 114 is mounted on a shaft 116 which extends downwardly from the shaft 38 and the spring 44 urges the cam follower 114 into engagement with the cam track 110.

The second guide rail 108 is supported in a position spaced above the first cam 96 by means of arms 109 which project outwardly from a disc 107. The disc 107 is supported above the cam 96 by a plurality of posts 105 to which it is secured by means of screws 103. The disc 107 has a central passage 101 within which the shaft 22 is a clearance fit.

The label storage magazine 14 may be in any convenient form including a receptacle which includes an open front end 120 and a spring 122 for urging a stack of labels 124 towards the open front end 120.

The glue applicator 126 includes an applicator roller 128 which is mounted for rotation in the housing 130 about a vertical axis. Preferably the applicator roller 128 is mounted on the end of a shaft 132 of an air cylinder (not shown) so that if a label is not properly secured to the head 56 as it approaches the glue roller 128, the absence of a label may be detected by means of a suitable label detecting means and the air cylinder may be activated to withdraw the roller 128 out of the path of the head 56 so that glue is not applied directly to the head. The glue applicator is of the type wherein rotation of the glue roller 128 within the housing causes glue to be applied to the roller 128 from an internally located glue reservoir.

In the embodiments illustrated in the present invention the labels are applied in the container labelling station 18 to containers such as bottles 134 or the like. Bottles are fed through the label applicator station by any convenient drive means (not shown) such as a conventional timing screw or the like. The bottles are rotated about their own axis while in engagement with the head 56 so that the label is applied on the bottle during passage of the bottle through the labelling station. The radius of the outer surface 78 of the head 56 is such that it is a tangent to the surface of the container to which the label is applied so that there is no relative scuffing movement between the surface of the head and the container as both move through the labelling station.

Figure 2:
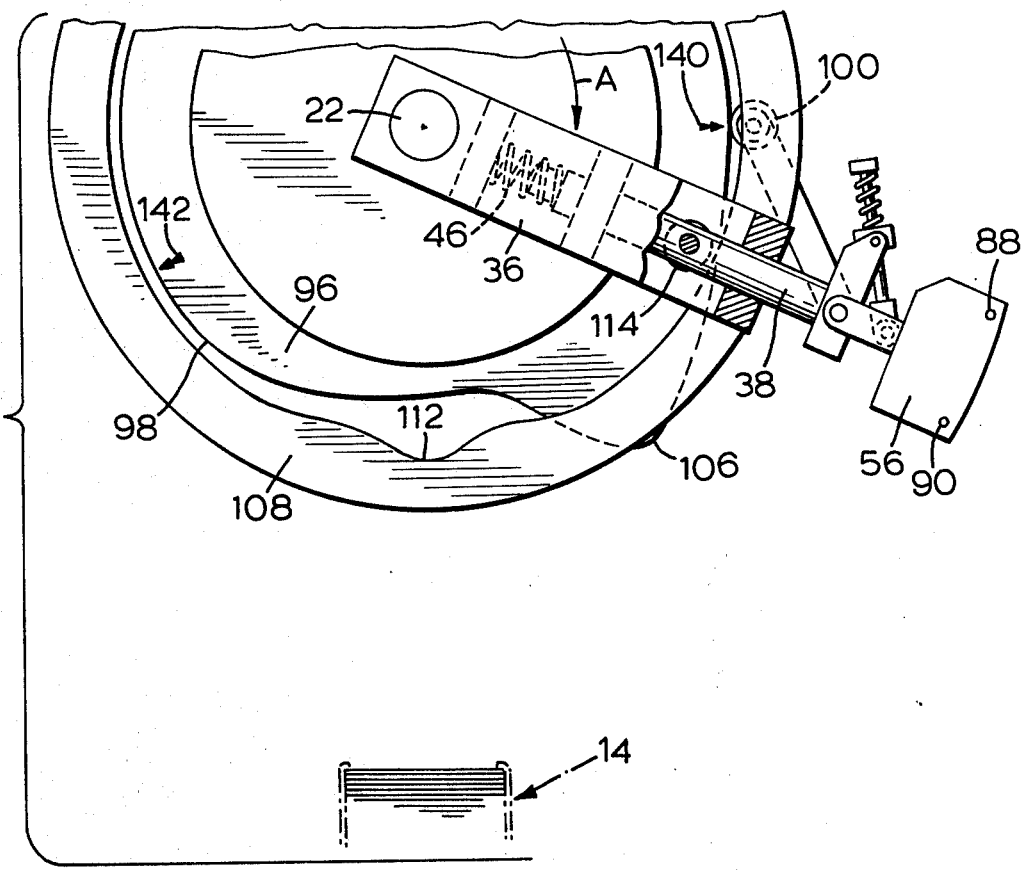
FIG. 2 is a partial plan view of the labelling device of FIG. 1 illustrating the location of the pick-off head when it is spaced a substantial distance from the label dispenser magazine.
Figure 3:
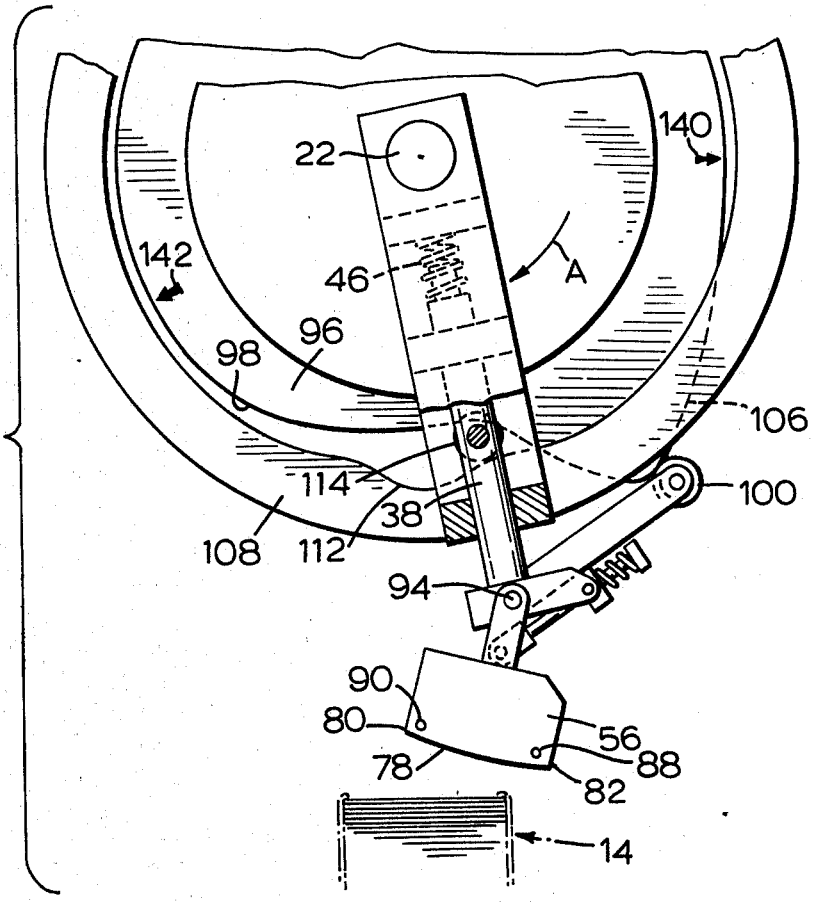
FIG. 3 is a plan view similar to FIG. 2 illustrating the position of the pick-off head as it approaches the label dispenser magazine;.
Figure 4:
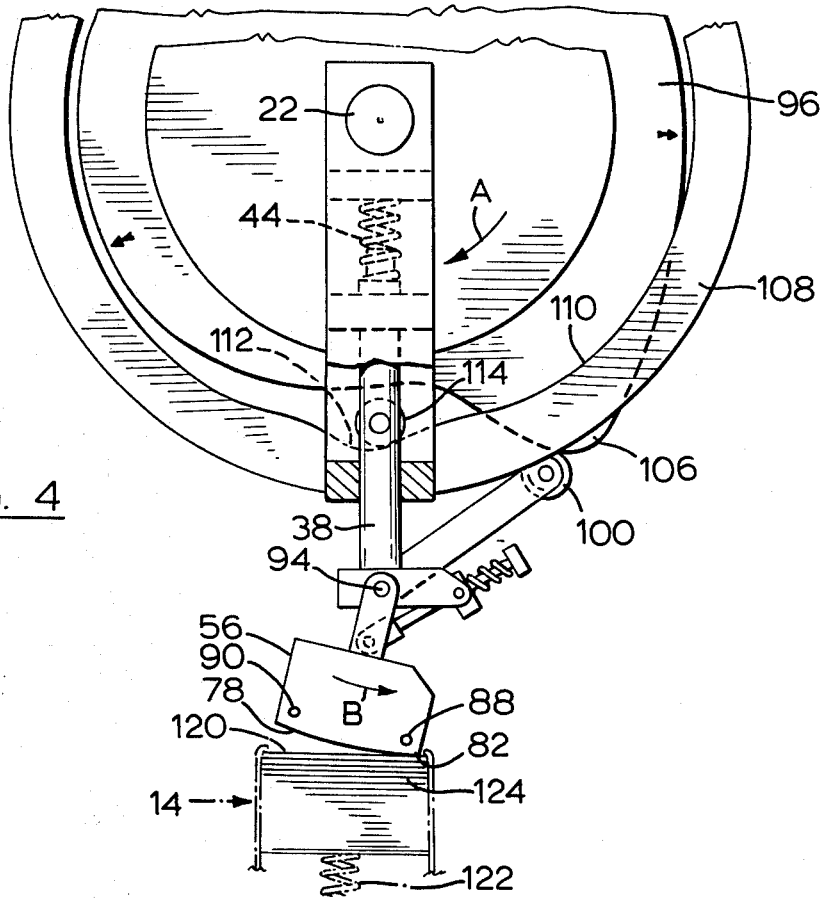
FIG. 4 is a plan view similar to FIG. 3 illustrating the manner in which the pick-off head makes initial contact with the label storage magazine.
Figure 5:
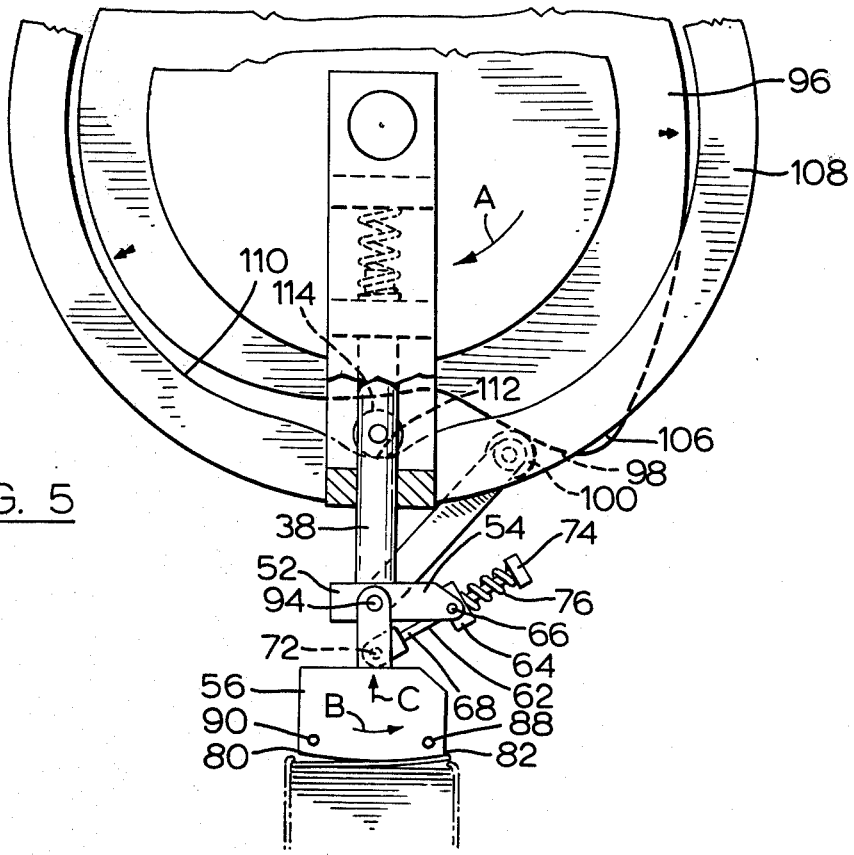
FIG. 5 is a plan view similar to FIG. 4 illustrating a further position of the pick-off head.

In use, the main body member or arm 26 is rotatably driven with the shaft 22 in the direction of the arrow A. As shown in FIG. 2 of the drawings, the head 56 is radially aligned with the shaft 38 and arm 26 as it approaches the label storage station 14 prior to engagement of the follower member 100 with the active portion of the cam rack 98 which extends between arrows 140, 142. Rotation of the main body portion from the position shown in FIG. 2 to the position shown in FIG. 3 causes the follower 100 to move radially outwardly along the surface of node 106 which causes the head 56 to pivot about the second axis 94 so that the trailing edge 82 at the outer surface 78 is disposed radially outwardly from the leading edge 80. As shown in FIG. 4 of the drawings, the trailing edge 82 is the first portion of the head 56 which engages the outermost label 124 of the stack of labels through the opening 120 in the outer end of the label storage magazine. The suction applied to the passages 84 which are located adjacent the trailing edge 82 serve to secure the label to the head 56 in the area of the landing edge 82. Continued rotation of the main body portion causes the follower 110 to move radially inwardly along the inwardly inclined portion of the node 106 and this action causes the head 56 to pivot in the direction of the arrow B about the second axis 94. Simultaneously therewith, the cam follower 14 moves radially outwardly into the node surface 112 of the guide track 110 which causes the shaft 38 to move outwardly under the influence of spring 44 which in turn causes the axis 94 to be moved radially outwardly towards the label dispenser station 14. This action causes a rocking action of the outer surface 78 of the head 56 to the position shown in FIG. 5 of the drawings, during which time the head is pushed into the open end of the dispenser magazine 120 to facilitate the removal of a label therefrom. Continued rotation of the main body from the position shown in FIG. 5 to the position shown in FIG. 6 causes simultaneous pivoting of the head 56 about the axis 94 in the direction of the arrow B and radially inward movement of the head in the direction of the arrow C. The radially inward movement is caused by the follower 114 moving along the second guide track 110 and the rocking action in the direction of the arrow B is caused by the follower 100 moving radially inwardly along the track 98 in response to rotation of the main body in the direction of the arrow A. The combined effect of the movement of the head in the direction of the arrow C and in the direction of the arrow A causes the trailing edge 80 of the head to move into engagement with the label so that the suction passages 86 serve to secure the other edge of the label to the potion of the outer surface 78 of the head adjacent the leading edge 80 as shown in FIG. 6 of the drawings. Continued rotation of the main body in the direction of the arrow A indicated in FIG. 6 causes the label 124 to be removed from the label storage station 14 and to move with the head 56 towards the glue applicator station. After the cam follower 100 passes the arrow 142 on the cam track 98, the cam track 98 assumes its circular path about the axis 20. Similarly after the cam follower 114 is elevated out of the node recess 112, it follows the circular path of the cam track 110. As previously indicated, when the cam followers are disposed in the circular portions of the cam track, the arm of curvature of the outer surface of the head is disposed on a radius generated from the central axis 12 so that as the head moves through the glue applicator station, the outer surface is disposed at a tangent to the glue applicator roller 128 which applies glue to the surface of the label 124 which is directed towards the roller 128. Similarly, the head 56 passes through the label applicator station 18 with the outer surface thereof disposed at a tangent to the surface of the container 134 so that the label is picked off of the head 56 by the rotation of the containers in the direction of the arrow B during their longitudinal movement through the labelling station in the direction of the arrow F.

Various modifications of the present invention will be apparent to those skilled in the art without departing from the scope of the invention. For example, it will be understood that whereas in the embodiments illustrated the main body 13 is illustrated and described as including only one arm member 26. The arm 26 may be replaced by a circular disc or by a plurality of arms so that a plurality of heads may be mounted at spaced intervals about the axis 20.

It will also be apparent that the relative positions of the cam tracks may be reversed. These and other modifications of the illustrated embodiment of the invention are well within the scope of the individual skilled in the machine tool building art and do not depart from the scope of the present invention.

An important feature of the present invention resides in the provision of a mechanism which disposes the pick-off head in a position with the trailing edge thereof radially outwardly of the leading edge thereof in conjunction with a mechanism which serves to pivot the head in a rocking action after initial engagement of the trailing edge of the head with the label in the label dispensing station. The rocking action also serves to facilitate the final withdrawal of the label from the label storage station.

The efficiency of the pick-off action of the head is improved by providing the second camming action which causes radial reciprocation of the head towards and away from the storage station after initial engagement of the label by the head. This depresses the stack of labels inwardly of the storage station to release the edges of the labels from the retaining flange edges of the storage station and facilitates the removal of the leading label from the storage station.

The pick-off efficiency of the head is further improved by reason of the fact that two distinct sets of suction openings are formed in the head, one set being formed adjacent the trailing edge of the head and the other set being formed adjacent the leading edge of the head so that when the trailing edge of the head makes its initial engagement with the label, the first set of vacuum passages serves to secure the adjacent portion of the label to the head and the fact that the second set of vacuum passages is not covered by the label does not detract from the efficiency of the vacuum by reason of the fact that the first set and second set of vacuum passages are connected to a source of vacuum through independent passages.

A further feature of the present invention which serves to reduce the likelihood of damage to the label during the labelling operation resides in the fact that the outer surface 78 of the head 56 is formed with an arc of curvature generated from the central axis 20 so that the outer surface 78 may pass through the glue applicator stations along a path which is tangential to the surface of the glue applicator roll and through the label applicator station along a path which is tangential to the path of travel of the container to which the label is to be applied.

Figure 7:
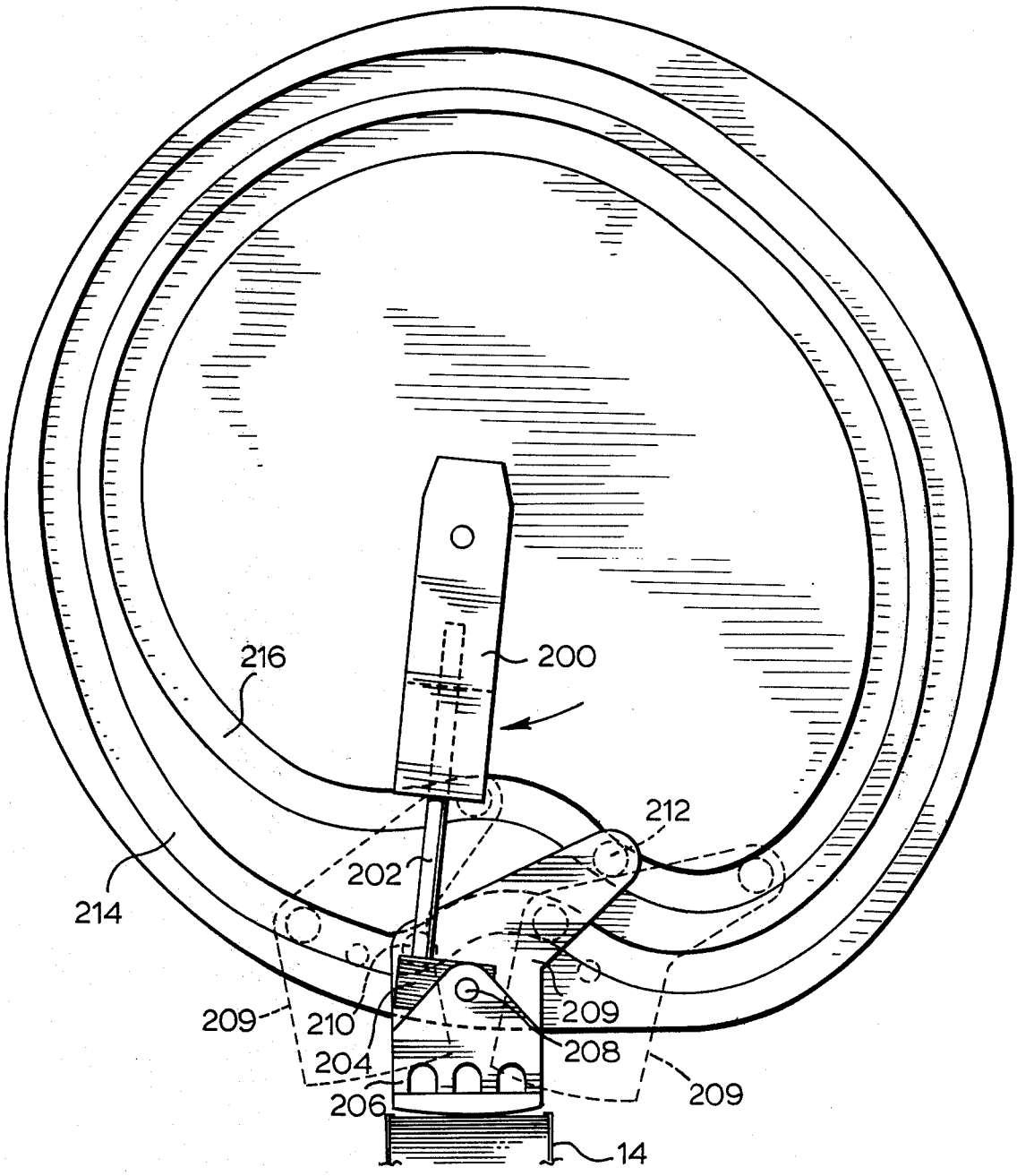
FIG. 7 is a plan view of a further embodiment of the present invention.
Figure 8:
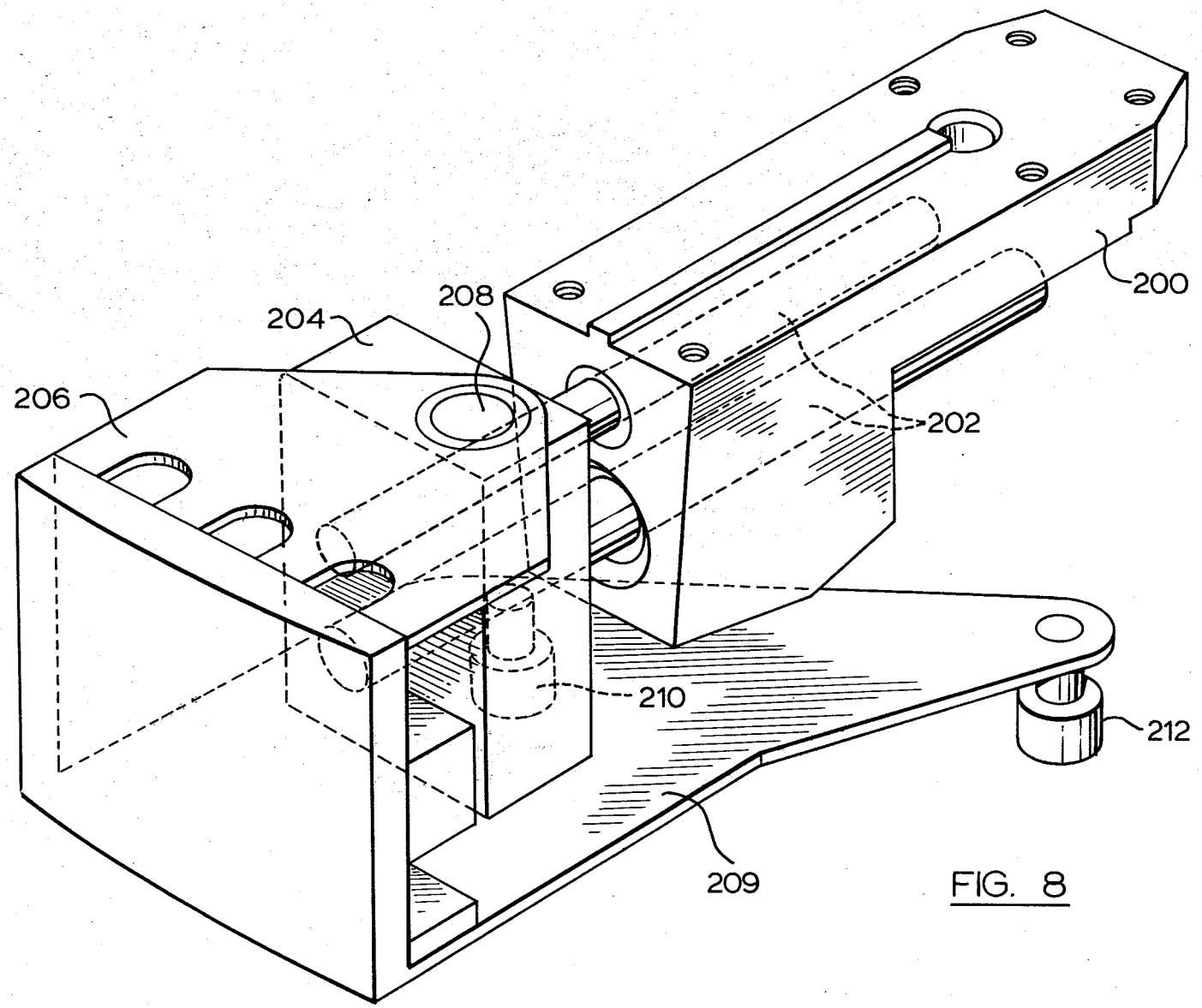
FIG. 8 is a pictorial side view of the rotor and head assembly of FIG. 7.

A modified form of rotor and head assembly is illustrated in FIGS. 7 and 8 of the drawings. As shown in FIG. 8 of the drawings, the main body or rotor 200 has a pair of shafts 202 slidably mounted therein for radial movement with respect to the central axis about which the rotor 200 is rotated. An anchor block 204 is rigidly secured with respect to the outer ends of the shafts 202. A head 206 is pivotally mounted on the anchor block 204 by means of pivot pins 208 (only one of which is shown) arranged above and below the block 204. The head 206 has a base plate 209 upon which cam followers 210 and 212 are mounted. In this embodiment, both cam followers 210 and 212 are connected to the head. The cam 210 is mounted to follow the cam track 214 (FIG. 7) and the cam follower 212 is mounted to follow the cam track 216. The cam tracks 214 and 216 of this embodiment are coplanar and formed with an appropriate profile to provide the same knuckling action as previously described with reference to FIGS. 1 to 6 of the drawings.

Figure 9:
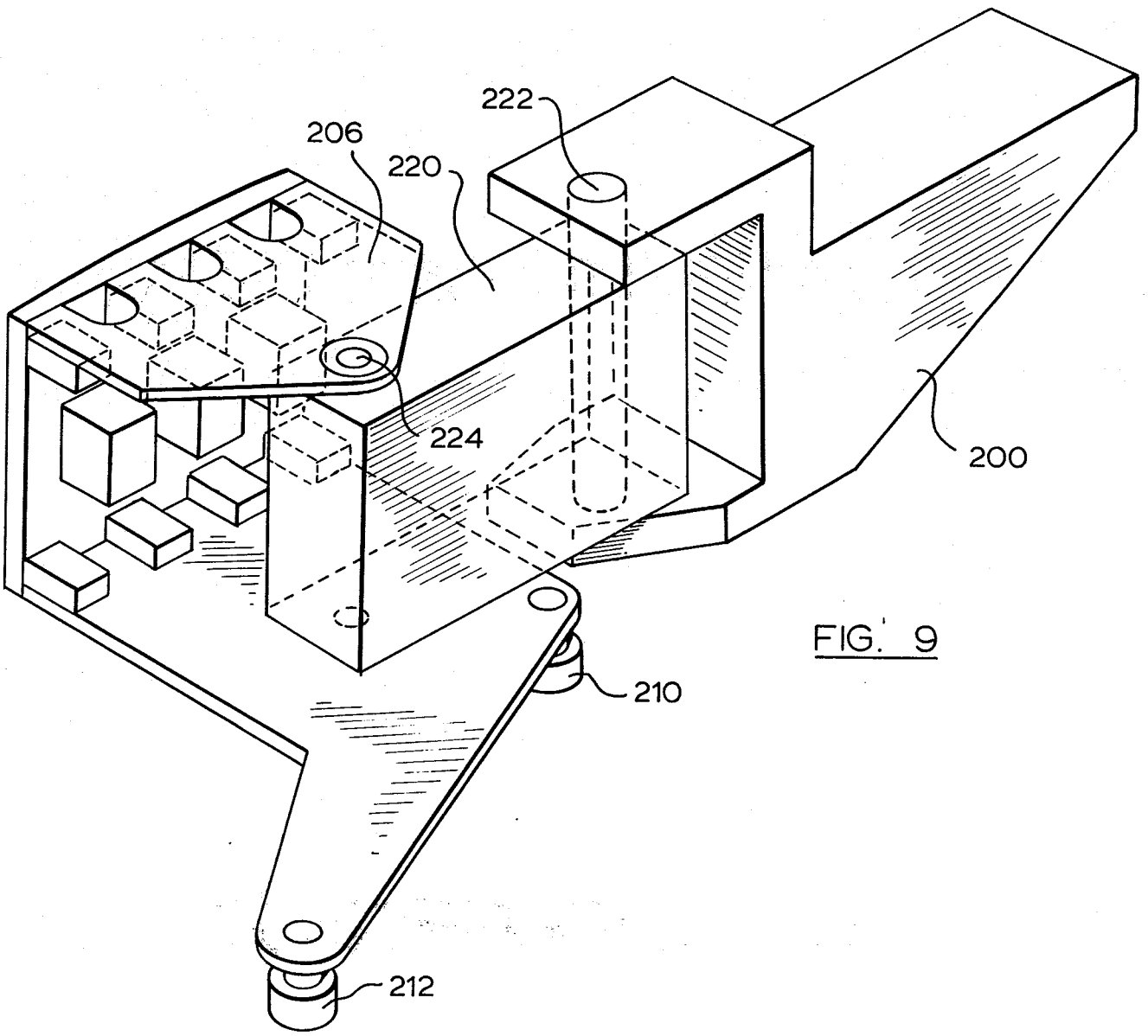
FIG. 9 is a pictorial side view of a rotor and head assembly according to a still further embodiment of the present invention.

In the further embodiment illustrated in FIG. 9 of the drawings, the head 206 is connected to the rotor 200 by means of an intermediate link arm 220. Link arm 220 is pivotally connected to the head 200 by a pivot pin 222. The head 206 is pivotally connected to the link arm 220 by a pivot pin 224. In use, the link arm 220 acts as a drag link with the cam followers 210 and 212 causing pivotal movement of the head 206 and link arm 220 with respect to one another and with respect to the rotor 200 to attain the same knuckling action as previously described. The outward movement of the cam 210 in cam track 214 will displace the head 206 radially outwardly by causing pivoting of the link arm 220 with respect to the rotor 200 while the cam follower 212 will cause pivotal movement of the head 206 with respect to the link arm 220 about pivot point 224. It will be apparent from this embodiment that the movement in the radial direction can be achieved without the use of the arms slidably mounted in the rotor or head member described in the embodiment illustrated in FIGS. 1 to 6 of the drawings.

These and other advantages of the structure of the present invention will be apparent to those skilled in the art.

What I claim is:

1. In a labelling device having a frame, a label storage station, a glue applicator station, and a label applicator station circumferentially spaced from one another about a central axis of said frame, said label storage station having a label storage magazine opening inwardly thereof for storing a plurality of labels in a face-to-face relationship, a label transfer device comprising, a. a main body member mounted on said frame for rotation about said central axis, b. at least one arm member slidably mounted on said main body member and projecting radially from said main body member, each said arm member having a longitudinal axis projecting radially from said central axis of said main body member, and each said arm member being slidable with respect to said main body member in a direction along said longitudinal axis, c. a head pivotably mounted on each arm member for movement about a secondary axis parallel to said central axis, said secondary axis being located on said logitudinal axis of said arm member, said head having an outer surface which is curved in the plane of rotation of said head about said central axis, said head being rotatable with said main body member with said outer surface disposed in a path passing through said label storage, glue applicator and label applicator stations, said outer face having a leading edge disposed in the direction of rotation of said main body member and a trailing edge disposed in the opposite direction, d. first guide means for guiding said head to pivot about said secondary axis to angularly incline said head to a first position as it approaches said label storage station in which said trailing edge of said head is disposed radially outwardly of said leading edge whereby said trailing edge is the first portion of said head to engage a label in said storage station, said first guide means being adapted to cause said head to pivot about said secondary axis from said first position to a second position in which said leading edge is disposed radially outwardly of said trailing edge whereby said outer surface is rocked about said secondary axis during movement of said head through said label storage station, and e. means for securing said label to said outer surface of said head as it moves through said label storage station to be transferred thereby to said labelling station.

2. A labelling device as claimed in claim 1 including second guide means for effecting reciprocal movement of said arm member with respect to said main body member during movement of said head between said first and second positions to move said head radially into and out of said label storage station.

3. A labelling device as claimed in claim 2 wherein said first guide means includes a cam track means extending about said central axis and a cam follower means mounted on said head, said cam track means including a node disposed in advance of said label storage station and said cam follower means including a trailing cam follower arm projecting from said head for engaging said node as said head approaches, passes through and withdraws from said label storage station.

4. A labelling device as claimed in claim 3 wherein said second guide means includes a second cam track extending about said central axis and a second cam follower mounted on said arm member, said second cam track having a node radially aligned with said label storage station for guiding said second cam follower toward said label storage station during movement of said head between said first and second positions.

5. A labelling device as claimed in claim 1 wherein said means for securing a label to said outer surface of said head includes first and second suction passage means, said first suction passage means opening at said outer surface of said head adjacent trailing edge thereof and said second suction passage means opening at said outer surface of said head adjacent said leading edge thereof, and means for independently connecting said first and second suction passage means to a source of vacuum.

6. A labelling device as claimed in claim 1 wherein a plurality of arm members are slidably mounted on said body member at circumferentially spaced intervals whereby a plurality of labels are transferred in response to each rotation of said main body member about said central axis.

7. A labelling device as claimed in claim 1 wherein said outer surface of said head has an arc of curvature generated from said central axis of a radius equal to the distance from said outer surface of said head to said central axis.

8. A labelling device as claimed in claim 7 wherein said glue applicator station includes roller applicator means mounted for rotation about an axis parallel to said central axis, said roller having an applicator surface disposed substantially tangentially with respect to the path of travel of said head through said glue applicator station whereby said roller is rotatably driven by engagement with said head as it passes through said applicator station to apply glue to said label.

9. A transfer device for withdrawing and transferring an item from a dispenser station containing a plurality of items to a receiving station comprising, a. a frame, b. rotor means mounted on said frame for rotation about a first axis, c. at least one arm member mounted on said rotor means and projecting radially from said first axis, d. a head pivotably mounted on each arm for movement about a secondary axis parallel to said first axis, said head having an outwardly directed transfer surface having a leading edge disposed in the direction of rotation thereof about said first axis and a trailing edge disposed in the opposite direction, said secondary axis being radially movable relative to said first axis in response to movement of said head between an extended position and a retracted position as said head moves past said dispenser station, e. first guide means for causing said head to pivot about said secondary axis to angularly incline said head to a first position as it approaches said dispenser station in which the trailing edge is disposed radially outwardly of the leading edge whereby the trailing edge is the first portion of the head to engage the leading item at the dispenser station, said head being mounted to pivot about said secondary axis during its traverse through said dispenser station such that said outer surface is rocked about said secondary axis to bring said leading edge into engagement with the item to be transferred from said dispenser station, f. means for securing an item to said outer surface of said head as it moves through said dispenser station to transfer the item by means of said head to said item receiving station.

* * * * *